US008091852B2

(12) United States Patent
Vassallo

(10) Patent No.: US 8,091,852 B2
(45) Date of Patent: Jan. 10, 2012

(54) HANGER DEVICE AND METHOD FOR HANGING AN OBJECT

(76) Inventor: Geoff Vassallo, Fremont, CA (US)

( * ) Notice: Subject to any disclaimer, the term of this patent is extended or adjusted under 35 U.S.C. 154(b) by 353 days.

(21) Appl. No.: 12/331,217

(22) Filed: Dec. 9, 2008

(65) Prior Publication Data

US 2010/0140428 A1 Jun. 10, 2010

(51) Int. Cl.
*A47F 7/14* (2006.01)

(52) U.S. Cl. ..... 248/475.1; 248/489; 248/466; 248/339; 428/542.4

(58) Field of Classification Search ..... 248/300, 248/682, 447.1, 489, 475.1, 200, 205.1, 220.21, 248/220.22, 309.1, 314, 317, 339, 476, 466; 428/542.4, 542.2, 16, 99; 294/61; 40/800, 40/757; 211/70, 103
See application file for complete search history.

(56) References Cited

U.S. PATENT DOCUMENTS

| | | | | |
|---|---|---|---|---|
| D219,768 | S | 1/1971 | Conwill | |
| D243,655 | S | 3/1977 | Matousek | |
| 4,315,615 | A * | 2/1982 | Scocozza | 248/489 |
| 4,464,440 | A * | 8/1984 | Dotzman | 428/542.4 |
| 4,611,780 | A | 9/1986 | Robertson | |
| 4,641,817 | A * | 2/1987 | Clark et al. | 267/140.13 |
| 4,871,140 | A | 10/1989 | Hoskinson | |
| 5,048,788 | A | 9/1991 | Lorinez | |
| 5,259,028 | A * | 11/1993 | Westbrook | 379/455 |
| 5,779,294 | A | 7/1998 | Magri | |
| D418,044 | S * | 12/1999 | Schoeneweis | D8/354 |
| 6,575,418 | B1 * | 6/2003 | Riday | 248/317 |
| 7,819,370 | B2 * | 10/2010 | Ho | 248/304 |
| 2005/0006554 | A1 * | 1/2005 | DeLine | 248/475.1 |
| 2009/0108158 | A1 * | 4/2009 | Kim et al. | 248/226.11 |

OTHER PUBLICATIONS

Van Dykes Taxidermy Online Catalog, www.vandykestaxidermy.com, Super Lock Bracket (item 01002840), Super Lock Hanger (item 01003839), Ultimate Super Lock Hanger Unit (item 01003838), Super Duty Strap Hanger (item 01329699), Hanger System (item 01330174), Sawtooth Hanger (item 01344329), Finishing Touch Econoline (item 01330459), Heavy Duty Hanger (item 01329756).

* cited by examiner

*Primary Examiner* — Terrell McKinnon
*Assistant Examiner* — Todd M Epps
(74) *Attorney, Agent, or Firm* — John C. Merchant

(57) ABSTRACT

A hanger and method for hanging is disclosed, the hanger for the purposes of hanging objects on substantially vertical surfaces such as walls, beams and posts. The hanger comprises a single-piece bracket of substantially flat suitable material. One portion of the bracket is attachable to the object to be hung using fasteners or other means and supports the weight of the object on support hardware using a concave support edge. The support edge is a tapered concave edge which may have a slotted center designed to fit typically used vertical support hardware (such as nails, screws of pegs) extending from a substantially vertical support surface such as a wall, beam or post. Another portion of the bracket extends away from the support edge and beyond the outer edge of the object to be hanged and includes a fastener opening for securing the alignment of the object relative to the vertical support using typical fasteners (such as nails or screws). The method of hanging comprises the steps of securing the hanger to the object to be hanged, supporting the weight of the object on the extending vertical support hardware using the hanger support edge, aligning the object, and securing the alignment of the object on the vertical support by fastening the hanger to the vertical support using fastener means.

1 Claim, 6 Drawing Sheets

HANGER DEVICE AND METHOD FOR HANGING AN OBJECT

CROSS REFERENCES

None

FEDERALLY SPONSORED RESEARCH

Not Applicable

SEQUENCE LISTING OR PROGRAM

Not Applicable

BACKGROUND

1. Field of Invention

The present invention relates to a hanger and method for hanging objects on walls, posts and other vertical supports.

2. Prior Art

A wide variety of hangers are currently used for mounting objects on walls, posts and other vertical supports. These objects vary from primarily ornamental objects such as pictures, sculpture, mounted hunting trophies, plaques and other decorative objects to primarily utilitarian objects such as clocks, televisions, light fixtures and the like. Some hangers have been designed to solve particular problems associated with hanging certain objects. For example, a variety of specialized hangers have been designed to hang flat screen televisions on walls. But, generally speaking, most hangers consist of hardware (such as wire, loops, brackets and the like) which are attached to the object to be mounted (or hung) and then are coupled with support hardware (such as nails, posts, pegs or brackets) which are attached to and extend from a vertical support (such as a wall, post, or beam).

One example of a typical picture hanger (or hanger system) is a length of wire which is attached by fasteners at opposite ends to the back of a picture frame. The wire extends horizontally along the rear upper portion of the frame. This allows a person hanging the picture frame to support frame on a hook or peg extending from the vertical support surface and then orient the frame relative to the wall by sliding the wire over the hook or peg to a position which evenly balances and orients the frame in the desired position relative to the wall. This system has the benefit of providing an easy way to orient and center the frame once the weight of the frame is supported. Other systems do not use a wire, but instead utilize one or more brackets attached to the back of the object to be hung. For example, some brackets have one or more saw-tooth-shaped openings positioned horizontally along the top of the bracket. The object is supported on the wall by positioning one of these openings over a hook or peg extending from the wall. The orientation of the object on the wall is determined, in part, by the choice of opening upon which to support the bracket on the peg or hook. Other systems utilize uniquely designed male/female coupling hardware to better secure and orient the object on the wall. These systems include uniquely designed hardware which is attached to and extends from the wall instead of simple hooks, nails or pegs. The bracket that is attached to the object to be hung is designed to fit into the hardware attached to the wall.

All these hangers (or hanger systems) provide ways to meet the challenge of easily and effectively securing and orienting objects on walls and other vertical supports. But these hangers and systems often full to easily and adequately address certain issues. For example, most hangers don't adequately meet the challenges associated with hanging larger, heavier or unevenly balanced objects.

Supporting an object quickly and easily. One challenge associated with hanging a large, heavy or awkwardly balanced object on a wall or other vertical support surface is the challenge of placing the object quickly and easily on the support hardware (i.e. the hardware attached to and extending from the wall, such as a nail, hook or peg) which may be hidden from view once the object is placed over it. One often has to physically support the object while attempting to couple the hardware attached to the back of the object with the hardware extending from the wall. This task can be particularly challenging if one has to place the object overhead or while standing on a ladder, for example. The hardware mounted to the back of the object to be hung must be quickly aligned with the vertical support hardware. And prior art systems providing hangers attached to the back of the object which are completely hidden from view (i.e. on the back of the object to be hung) create additional difficulty because both it and the support hardware extending from the wall are hidden from view during the coupling process. One has to manage the weight of the object while moving the object around to find an adequate coupling of the hanger with the support hardware. Further, prior art systems often call for multiple support hardware devices (i.e. more than one nail or screw) to provide proper support. Embodiments incorporating the principles of the present invention are supported using a single nail or post.

Achieving and securing proper orientation. Another challenge is in adequately orienting the object once it has been supported on support hardware attached to the wall. Many larger, heavier objects such as mounted trophies or sculpture are asymmetric or are unevenly balanced. Such objects have the tendency to lean or rotate once supported on a single nail or peg thus causing the object to move out of proper alignment once the weight of the object is supported thereon. Systems which allow for adjustment of orientation once the object is hung tend to be less secure and/or provide only a temporary solution. It is not uncommon, for example, to see picture frames utilizing wire hanger systems tilting one way or another on a wall because they have been jolted from there original position by some shifting in the building or even by the gradual work of gravity on the support system.

Securing the connection. Another challenge associated with hanging larger, heavier and unevenly balanced objects on a wall (and particularly those mounted overhead) is insuring the connection once the hanger is hung on the support hardware extending from the wall. One needs to be sure that an object, once hung, will not fall off the support hardware. A sagging building, a slamming door, or an earthquake may cause objects which are initially secure to work loose and fall. Most hangers don't provide a way to secure the coupling of the hardware to prevent this from happening.

Adequate positioning on structural supports. Another common challenge associated with hanging heavier objects on walls is properly securing the vertical support hardware (for example, the nail, screw or peg extending from the wall) to a stud or other structurally sound vertical support. Typical residential wall systems consist of gypsum board supported by wall studs. While some vertical support hardware is designed specifically for use with gypsum board, this hardware is often expensive, messy and difficult to install. There is also a limit to the amount of weight that can be supported on such support hardware because the structural integrity of the gypsum board itself is limited. This is why manufacturers of hanging systems for larger heavier items such as flat screen televisions, clocks and larger sculptures or art work recommend that one support the object on vertical support hardware that is securely connected to a structural support such as a stud or beam.

Orienting a heavier object on a wall where the vertical support hardware is positioned into a stud or beam which isn't in line with the location in which the installer wants to place the object on the wall is problematic. The installer may have to choose between hanging the object in the desired place or hanging it on support hardware attached to the stud or beam. An installer may position the hanger on the object slightly askew of center, but that may cause the object to lean one way or another once mounted. A hanger which can be placed off center on the object to be hung but which also allows reorientation and securing of the orientation on the wall once hung would be advantageous because it would allow the installer a greater ability to utilize a stud or beam that is located off-center of where the object is desired to be hung. This is particularly important in the context of residential wall systems which have a limited number of beams and/or utilize wall studs that are only 1½" wide and positioned 16" to 24" apart.

Too complicated and expensive to use and make. Another challenge associated with hanging larger, heavier or unevenly balanced objects on walls is that many available hanger systems are overly complicated, utilize too many specifically designed components and/or are expensive to make and use. Some systems utilizing specifically designed male/female couplings, springs or other complicated parts are expensive to make and buy. If one loses or breaks a particular part, a whole new system must be purchased to replace a single component. Further, one usually cannot simply remove an object from existing standard vertical support hardware (such as a standard hook, peg or wall screw) and hang another object on the same hook or peg. These systems require on to replace the hook or peg with the complementary system before hanging the object.

SUMMARY

In accordance with the principles of the present invention, the hanger and method for hanging described herein meets many of the challenges associated with hanging larger, heavier or unevenly balanced objects on walls and other vertical supports by utilizing a single-piece flat bracket having a concave tapered support edge to allow the weight of the object to be easily positioned and supported on typically used support hardware (such as a nail, screw, hook or peg) which is affixed to and extending from a wall or other vertical support. An elongated portion of the single-piece hanger is positioned to extend beyond the outside edge of the object to be hung and contains a fastener opening which allows one to easily and efficiently orient the object on the wall and secure the orientation. Once secured, the elongated portion prevents the hanger from sliding or otherwise moving off the vertical support hardware. It also allows visual verification that the hanger is secured and that the hanger will not accidentally slide off the support hardware.

The hanger device and method for hanging was designed specifically for use with mounted hunting trophies, sculpture and other heavy, often awkwardly balanced objects that are typically hung on walls and other vertical supports. But the hanger device and method for hanging described herein also works effectively for hanging lighter ornamental objects on vertical supports.

DRAWINGS—FIGURES

In the drawings, closely related figures have the same number but different alphabetic suffixes.

FIGS. 1*a*, 1*b* and 1*c* are front, back and side views of a first hanger embodying the principles of the present invention.

FIGS. 2*a*, 2*b* and 2*c* are front, back and side views of a second hanger embodying the principles of the present invention.

FIGS. 3*a*, 3*b* and 3*c* are front, back and side views of a third hanger embodying the principles of the present invention.

FIGS. 4*a*, 4*b* and 4*c* are front, back and side views of a fourth hanger embodying the principles of the present invention.

DRAWINGS—REFERENCED NUMERALS

Figure 1A:
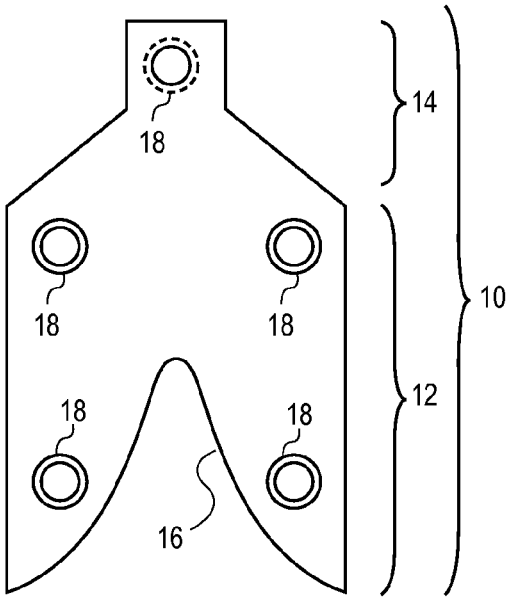

10—hanger
12—weight supporting portion
14—aligning and securing portion
16—concave support edge
18—fastener openings
20—fasteners
22—object
24—cavity
26—vertical support
28—vertical support hardware

DETAILED DESCRIPTION OF A HANGER AND METHOD FOR HANGING EMBODYING THE PRINCIPLES OF THE PRESENT INVENTION

The hanger and method for hanging embodying the principles of the present invention provide greater ease of installation and security over the prior art.

Overall Description. FIGS. 1*a* through 6*c* show various embodiments of a hanger embodying the principles of the present invention. Each embodiment of the hanger 10 is a substantially flat single-piece bracket made of a stiff durable material such as metal, heavy plastic or other material that can be easily formed and will not easily break, tear or bend. For purposes of discussion, the hanger 10 can be described as having two portions. The first portion is a weight-supporting portion 12 containing a concave support edge 16 designed for positioning on vertical support hardware 28 (such as a nail, screw or hook) and fastener openings 18 used to help fasten the hanger 10 to an object 22 to be hung using fasteners 20 (such as nails or screws). The second portion is an elongated aligning and securing portion 14 having one or more fastener openings 18. This second portion is elongated such that it will extend beyond an outside edge of the object 22 to be hung with its fastener opening 18 exposed thus allowing one to easily orient and secure the hanger 10 directly to the vertical support 26 using one or more fasteners 20.

Figure 1B:
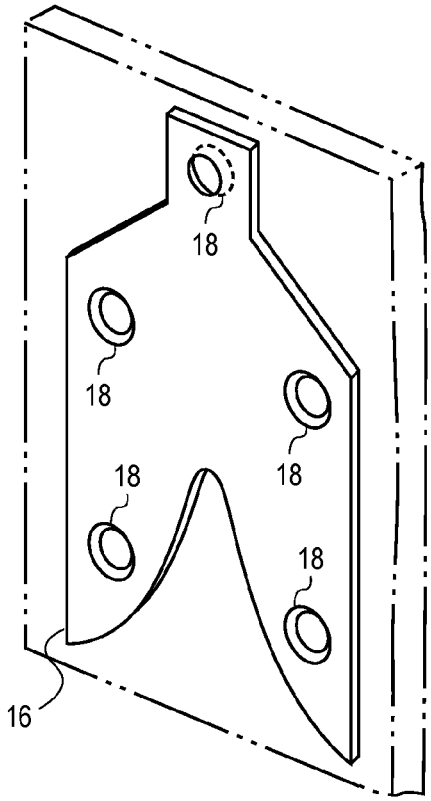
Figure 1C:
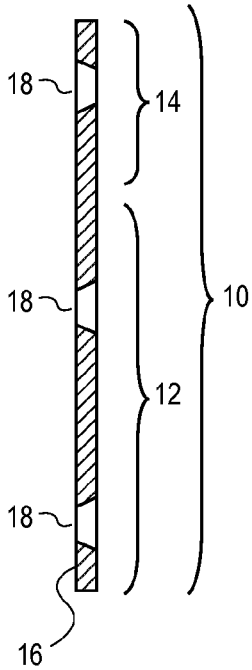

Preferred Embodiment Designed to Extend Above Top Edge of the Object. FIGS. 1*a* through 1*c* are front, back and side views of a preferred embodiment for hanging an object 10 to a wall or other vertical support 26 such that the aligning and securing portion 14 will extend above the top edge of the object 10 to be hung. While the overall shape of this preferred embodiment is primarily aesthetic, it incorporates the principles of the present invention. As shown, the support edge 16 is concave, substantially symmetrical, and forms a centered slotted top edge portion. The purpose of the concave support edge 16 is to provide an edge which will support the weight of the object 22 to be hung on the vertical support hardware 28. The contoured concave symmetrical shape the support edge 16 is advantageous in that it can be used with a variety of types of vertical support hardware 28 typically used to hang objects on walls and other vertical supports. It also helps position and center the hanger 10 on the vertical support hardware 28. The weight of the object helps guide the vertical support hardware 28 into the slotted center portion of the support edge 16. The slotted center portion provides additional lateral support and helps deter movement or shifting of the hanger 10 once it is positions on the vertical support hardware 28. In alternative embodiments, the support edge 16 may be substantially in the shape of an inverted "V" or "U".

One or more fastener openings 18 are positioned along one or more sides of the support edge 16 thus allowing for the use of fasteners 20 to secure the hanger 10 to the object 22 to be hung. In the preferred embodiment shown in FIGS. 1*a* through 1*c*, there are four fastener openings 18. Two of the fastener openings 18 are positioned to the left side of the support edge 16 and two are positioned to the right side of the support edge 16. Further, two of the fastener openings 18 positioned above the centered top portion of the support edge 16 and closer together than the two fastener openings 18 positions below the centered top portion of the support edge 16. This configuration of the fastener openings 18 is not absolutely necessary for proper attachment of the hanger 10 to the object 22, but provides additional stability against forces that might tend to pry and/or shearing the hanger 10 away from the object 22 once the weight of the object 22 is supported on the vertical support hardware 28. In alternative embodiments, the fastener opening 18 may be placed equidistant to one another or the top two openings could be positioned further apart than the bottom two openings. Other alternative embodiments may have one or more fastener openings. However, it is preferred that one fastener opening 18 be positioned above the top most edge portion of the support edge 16.

In this preferred embodiment, the fastener openings 18 are beveled to allow proper seating of the fastener 20 head to the top surface of the hanger 10. The bevels for those fastener openings 18 used to secure the hanger 10 to the object 22 would be on the top side of the hanger 10. In the preferred embodiment, the fastener opening (or openings) located in the aligning and securing portion 14 are also beveled but those bevels would be located on the opposite side of hanger 10 to allow proper seating of the fastener(s) 20 used to secure the hanger directly to the vertical support 22.

The preferred embodiment shown in FIGS. 1*a*-1*c* is intended for use in hanging an object 22 such that the aligning and securing portion 14 extends above the top edge of the object 10 to be hung. Therefore, the support edge 16 would be oriented downward. This configuration allows for easier placement of the hanger 10 on the vertical support hardware 28. This configuration also provides for easier use with vertical support hardware 28 of larger diameters.

The aligning and securing portion 14 of the hanger 10 is an elongated portion which extends away from the weight bearing portion 12 of the hanger 10 and beyond an outside edge of the object 22 to be hung. It has one or more fastener openings 18, as shown, allowing one to secure the alignment of the object 24 with respect to the vertical support 26 using fasteners 20. The aligning and securing portion may be of any shape as long as it extends beyond the outer edge of the object 22. But, in the preferred embodiment depicted in FIGS. 1*a*-1*c*, this aligning and securing portion is substantially rectangular with a fastener opening 18 located along the further edge. In alternative embodiments, such as that shown in FIGS. 2*a* through 2*c*, it is in the shape of the top leg of an inverted "Y" and has a rounded end with a single fastener opening 18.

Once the hanger 10 is properly supported on the vertical support hardware 28, the object 10 can be oriented as desired and the hanger 10 secured directly to the vertical support 26 thus preventing the object from rotating or inadvertently realigning itself as the result of object 22 being unevenly balanced and/or the object 22 being bumped out of position. The fact that the hanger 10 is secured directly to the vertical support 26 also prevents the hanger from becoming dislodged from the vertical support hardware 28.

The aligning and securing portion 12 of the hanger 10 can be of any length, but in a preferred embodiment as shown in FIGS. 1*a* through 6*c*, this portion is long enough such that the one or more fastener openings 18 extend beyond the outward edge of the object 10. This provides a visible guide for lining up and placing the support edge 16 on the vertical support hardware 28. It provides an easy way to visually orient the object 10 relative to the wall once the weight of the object 10 is supported by the vertical support hardware 28. And it provides visual assurance that the hanger 10 will not be easily dislodged from the vertical support hardware 28.

Figure 2A:
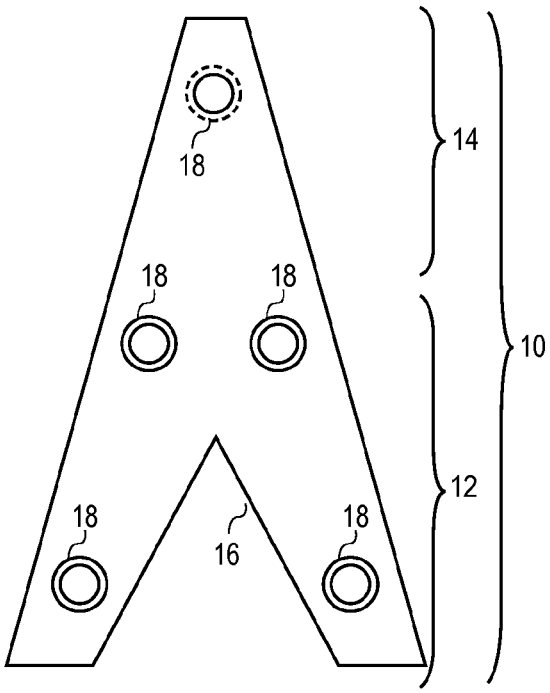
Figure 2B:
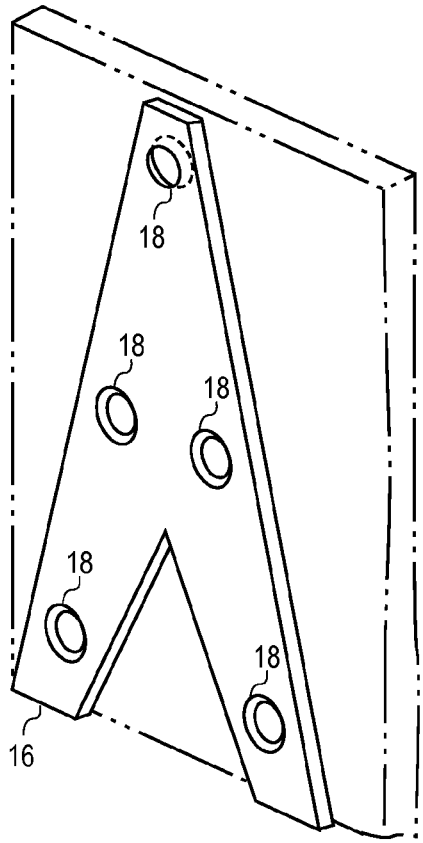
Figure 2C:
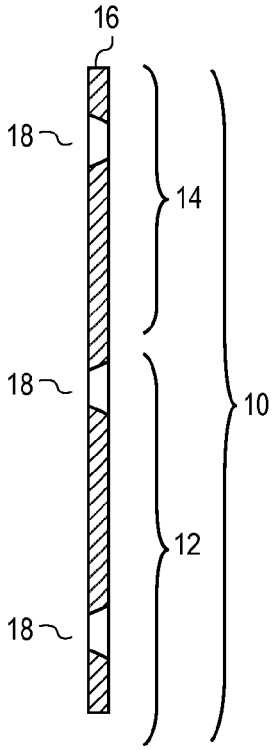

Alternate Embodiment Designed to Extend Above Top Edge of the Object FIGS. 2*a* through 2*c* are front, back and side views of an alternate embodiment for hanging an object 10 to a wall or other vertical support 26 such that the aligning and securing portion 14 will extend above the top edge of the object 10 to be hung. While the overall shape of this preferred embodiment is primarily aesthetic, it incorporates the principles of the present invention. This embodiment is similar that shown in FIGS. 1*a*-1*c* except that is substantially shaped like an inverted "Y" and invokes the shape of a teepee for aesthetic purposes. The weight bearing portion 12 has a support edge 16 shaped like an inverted "V". Fastener openings 18 are positioned above and below the top portion of the support edge 16.

Figure 3A:
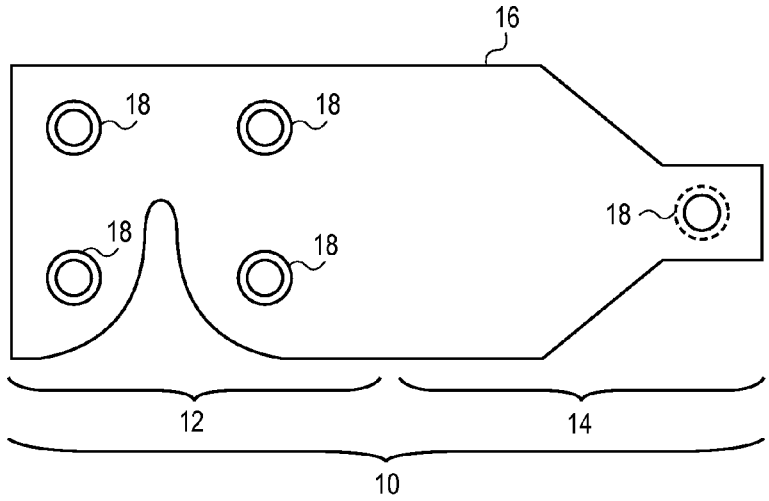
Figure 3B:
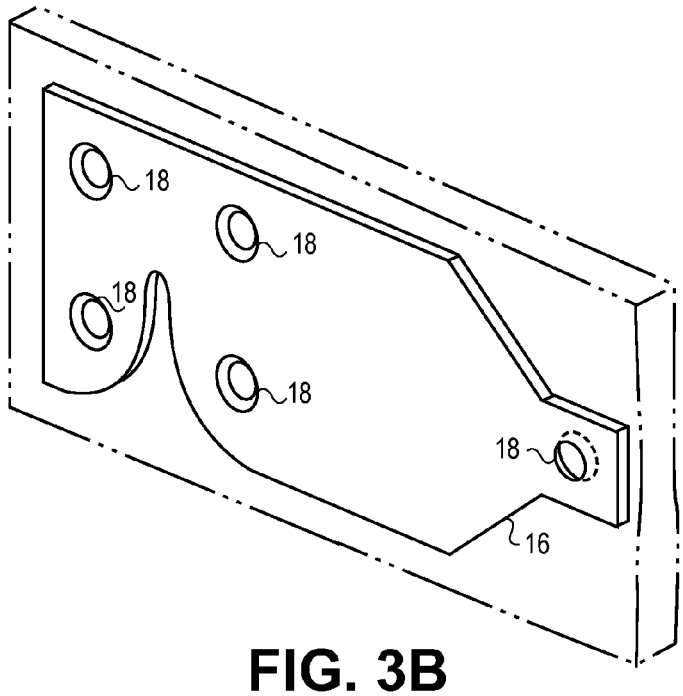
Figure 3C:
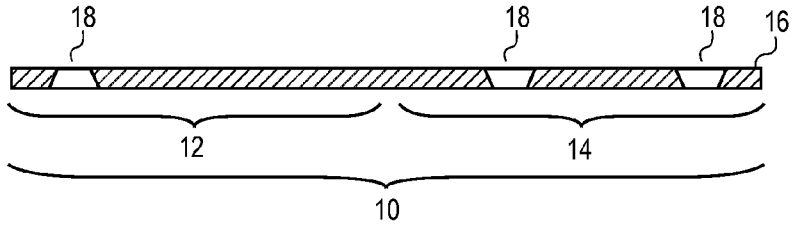

Preferred Embodiment Designed to Extend Beyond Side Edge of the Object. FIGS. 3*a* through 3*c* are front, back and side views of a preferred embodiment for hanging an object 10 to a wall or other vertical support 26 such that the aligning and securing portion 14 will extend beyond a side edge of the object 10 to be hung. While the overall shape of this preferred embodiment is primarily aesthetic, it incorporates the principles of the present invention. But, this preferred embodiment is designed to extend beyond a side edge of the object to be hung. Thus, the first weight bearing portion 12 containing the support edge 16 and fastener openings 20 for securing the hanger to the object 10 is positioned to one side and the aligning and securing portion 14 containing fastener opening (s) 20 for securing the hanger 10 to the vertical support 26 extends beyond the outside right or left edges of the object 10 to be hung.

Figure 4A:
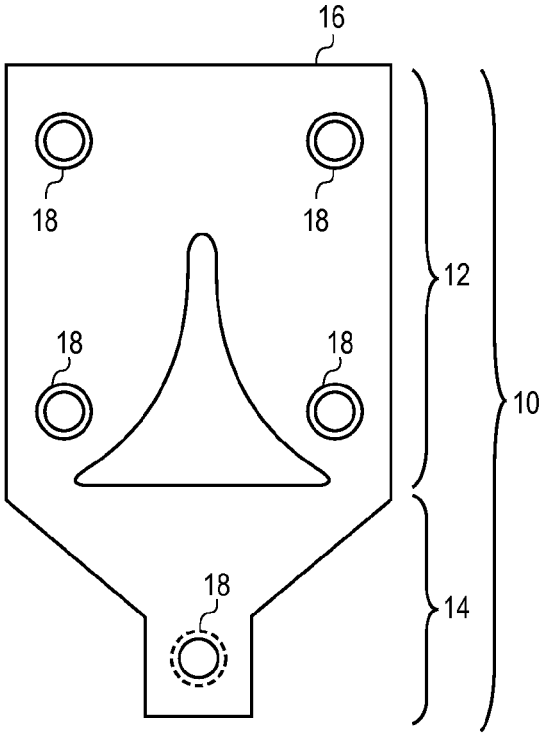
Figure 4B:
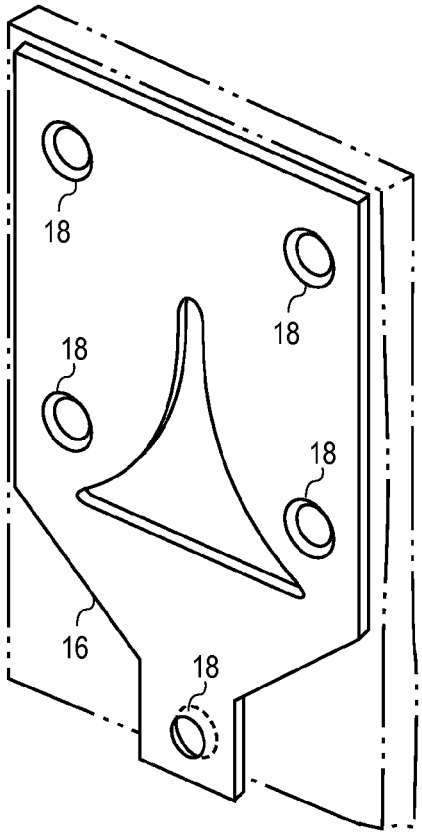
Figure 4C:
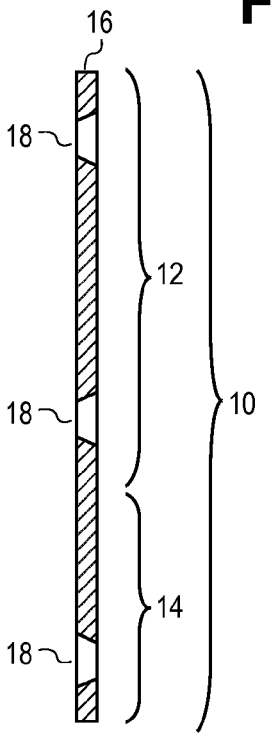

Preferred Embodiment Designed to Extend Beyond the Bottom Edge of the Object. FIGS. 4*a* through 4*c* are front, back and side views of a preferred embodiment for hanging an object 10 to a wall or other vertical support 26 such that the aligning and securing portion 14 will extend beyond the bottom edge of the object 10 to be hung. While the overall shape of this preferred embodiment is primarily aesthetic, it incorporates the principles of the present invention. This preferred embodiment is designed for situations where it is desired that the elongated portion extend beyond the bottom edge of the object to be hung. Thus, the support edge 16 is the top edge of a mouth or opening fashioned by the weight supporting portion 12.

Figure 5:
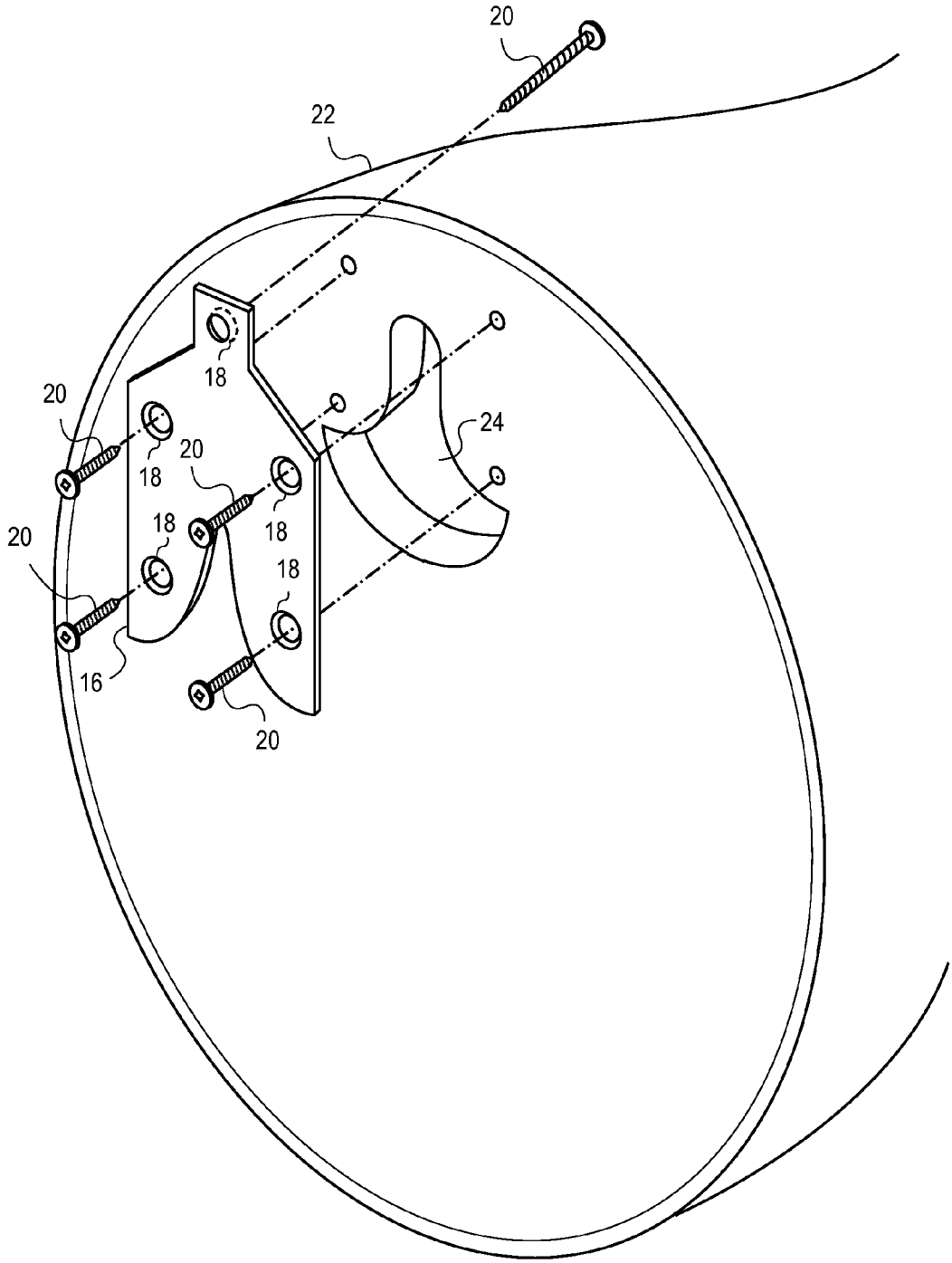
FIG. 5 depicts an exploded perspective view of a first hanger embodying the principles of the present invention mounted to an object to be hung.

Exploded Perspective View Showing Use of Hanger to Support Object on Vertical Support. FIG. 5 depicts an exploded perspective view of a hanger 10 embodying the principles of the invention being used to hang a mounted hunting trophy on a vertical support 26. The mounting base has a cavity 24 which will allow the tip of the vertical support hardware 28 to extend therein. The hanger 10 is mounted to the back of the object 22 which is, in this case, a hunting trophy, such that the support edge 16 fits over the cavity 24 with the fastener openings 18 positioned to the right and left of the cavity 24. The hanger 10 is also positioned such that the end of the aligning and securing portion 14 containing the fastener opening 18 for fastening the hanger directly to the vertical support 26 extends above the top edge of the object 22.

Figure 6:
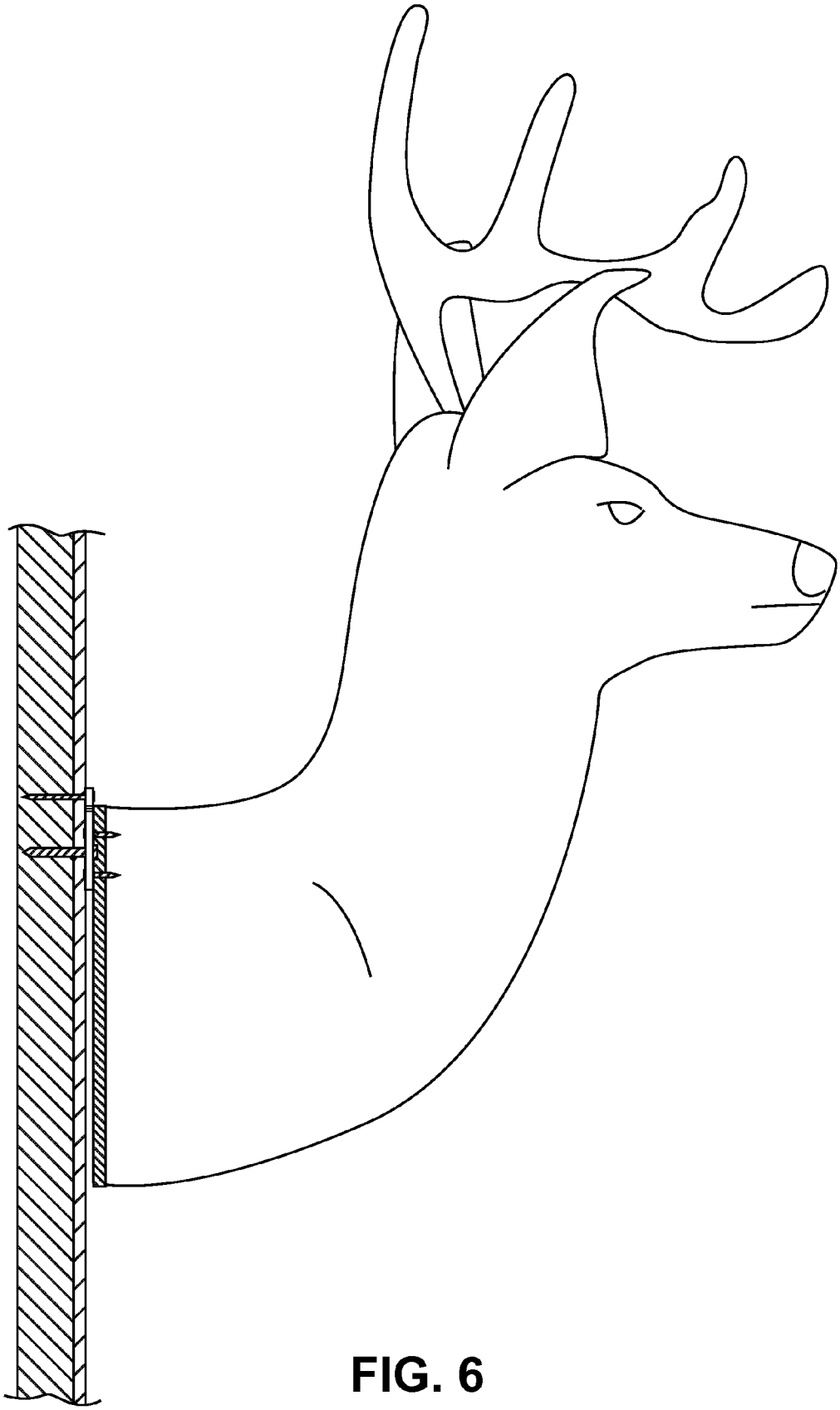
FIG. 6 depicts a perspective view of an object mounted to a wall using a hanger embodying the principles of the present invention.

FIG. 6 shows another perspective view of a hanger 10 embodying the principles of the invention used to attach a mounted hunting trophy to a vertical support 26.

Method for Hanging an Object on a Vertical Support. The steps associated with mounting an object on a vertical support using the hanger embodying the principles of the invention include:

a) Fastening the hanger 10 to the back of the object 22 using fasteners 18 such that the support edge 16 extends over a cavity 24 in the object 22 allowing the vertical support hardware to extend therein when hung,
b) Positioning the hanger 10 on the vertical support hardware 28 so that the vertical support hardware 28 rests in the center of the support edge 16,
c) Orienting the object 10 to a desired position relative to the vertical support, and
d) Attaching the hanger 10 to the vertical support 26 by securing fasteners 20 through the fastener opening 18 located on at the end of the aligning and securing portion 14 of the hanger 10.

The hanger 10 is mounted to the back of the object 22 and the hanger 10 is placed on the vertical support hardware 28 such that the support edge 16 is positioned over the object cavity 24 allowing the vertical support hardware 28 to extend from the wall and into the cavity 24. The center portion of the support edge 16 rests on the vertical support hardware 28 with the vertical support hardware 28 extending from the vertical support 26 into the cavity 24. Use of typical vertical support hardware 28 such nails and screws having a head on the extended end provides additional security against the support edge 16 sliding off the vertical support hardware 26 or the hanger 10 becoming dislodge from the vertical support hardware 26.

Alternative Embodiments. The hanger embodying the principles of the invention may be of any size that adequately fits the object to be hung. It can be made from any desired material such as sheet metal, plastic, wood or any other sufficiently strong material that does not easily break, bend or tear. The present inventor has found that metal is sufficiently strong to be used for this application and that metal is easy to fashion and relatively inexpensive to make and sell.

The Figures described above illustrate various embodiments of the hanger and a method for using the hanger to hang an object on a vertical support. The overall shape of each of the illustrated embodiments is primarily aesthetic, although each embodies the principles of the invention. Alternatives embodying the principles of the invention may include hangers which are neither rectangular, nor substantially in the shape of an inverse "Y" as depicted in the Figures. The hanger may be of any overall shape as long as it has a weight bearing portion containing a support edge and fastener holes and an elongated aligning and securing portion extending beyond the circumference of the object to be hung and having one or more exposed openings for attaching the hanger to the vertical support using fasteners. As long as the support edge is concave, it may be of any shape. As described, the elongated aligning and securing portion does not have to extend directly above, to the side or below the object to be hung as long as the hanger is shaped such that the aligning and securing portion extends beyond some outside edge of the object to be hung. The length of the aligning and securing portion depends on the desired location for attachment to the vertical support. It may extend just beyond the outside edge of the object, or it may extend far beyond the outside edge of the object. The present inventor has found that it is preferable for the extension to extend just beyond the outside edge so that it is visible, but can be easily hidden from view.

Advantages. From the description provided above, a number of advantages of the hanger become evident:

a) one can quickly and easily support the weight of the object on the vertical hardware;
b) one can achieve and secure proper orientation of the object once the weight has been supported;
c) one can be sure that the hanger will not slip from the vertical support hardware once all fasteners are secured;
d) one can visually verify that the hanger is secured;
e) the hanger resists seismic dislocation from the support hardware;
f) one can re-orient the object on the wall and secure the new orientation without having to lift the object from the vertical support hardware;
g) one can easily position the hanger so that the it is adequately secured to a structural support;
h) the hanger is easy to use and make;
i) the hanger can be used with a variety of typical fasteners and vertical support hardware;
j) accommodates variety of hangers used together; and
k) accommodates a variety of sizes and overall shapes of hangers.

Scope. Although the illustrated embodiments and description provided above contains specificity, it should not be construed as limiting the scope of the invention but as merely providing illustration of some of the presently preferred embodiments of this invention. The scope of the invention should be determined by the appended claims and their legal equivalents, rather than the examples given.

It will thus be appreciated that those skilled in the art will be able to determine numerous alternative embodiments that, while not shown or described herein, embody the principles of the invention and thus are within its spirit and scope.

What is claimed is:

1. A method for securing and aligning an object on a substantially vertical support comprising:

a) taking a substantially flat single-piece bracket having front and back sides and a body having first and second portions wherein
   1) the first portion of said bracket body has one or more fastener openings for attaching said bracket to an object by inserting fasteners through said one or more fastener openings from the back side of the bracket and a concave support edge for supporting said bracket on support hardware extending from said substantially vertical support and
   2) the second portion of said bracket body has one or more fastener openings for attaching said bracket to said substantially vertical support by inserting a fastener through said one or more fastener openings from the front side of the bracket and
   3) wherein said second portion of said bracket extends away from said first portion such that said one or more fastener openings extend beyond the outer edge of the object to easily allow aligned of said bracket on said vertical support and easily allow attachment of said bracket to said substantially vertical support by inserting a fastener through said one or more fastener opening from the front side of the bracket;

b) positioning the bracket over a cavity in the backside of the object such that the concave support edge is positioned within the circumference of the cavity to allow the concave support edge to be positioned on support hardware extending from said substantially vertical support and allowing said support hardware to extend into the cavity;

c) positioning the bracket such that one or more fastener openings located in the second portion of the bracket extend beyond the outer edge of the object;

d) fastening the bracket to the object by inserting fastening means through the fastener openings located in the first portion from the back of the bracket;

e) placing the concave support edge of the bracket on the support means extending from the substantially vertical support so that said support hardware extends into the cavity;

f) aligning the object on the substantially vertical support as desired; and g) inserting fastening means from the front side of the bracket through the one or more exposed fastener openings located in the elongated second portion of the bracket and into the substantially vertical support.

* * * * *